US006769356B2

(12) United States Patent
Frenken

(10) Patent No.: US 6,769,356 B2
(45) Date of Patent: Aug. 3, 2004

(54) METHOD OF OPERATING A HYDRAULIC PRESSING UNIT, AND HYDRAULIC PRESSING UNIT

(75) Inventor: Egbert Frenken, Wermelskirchen (DE)

(73) Assignee: Gustav Klauke GmbH (DE)

( * ) Notice: Subject to any disclaimer, the term of this patent is extended or adjusted under 35 U.S.C. 154(b) by 84 days.

(21) Appl. No.: 10/319,269

(22) Filed: Dec. 12, 2002

(65) Prior Publication Data

US 2003/0126905 A1 Jul. 10, 2003

(30) Foreign Application Priority Data

Dec. 13, 2001 (DE) ..... 201 20 204 U
Feb. 19, 2002 (DE) ..... 102 06 801

(51) Int. Cl.[7] ..... B30B 1/32
(52) U.S. Cl. ..... 100/269.01; 100/269.16
(58) Field of Search ..... 100/269.01, 270, 100/269.14, 269.15, 269.16, 269.18, 269.19; 72/453.01, 453.14, 453.15, 453.16, 453.17, 453.18, 453.19

(56) References Cited

U.S. PATENT DOCUMENTS 3,884,262 A * 5/1975 Assembergs ..... 137/489
3,973,595 A * 8/1976 Schmoll ..... 137/637.1
4,433,612 A * 2/1984 Spielvogel et al. ..... 91/514
5,315,744 A * 5/1994 Denham et al. ..... 29/243.53

* cited by examiner

*Primary Examiner*—Ed Tolan
(74) *Attorney, Agent, or Firm*—Trexler, Bushnell, Giangiorgi, Blackstone & Marr, Ltd.

(57) ABSTRACT

The invention relates to a method of operating a hydraulic pressing unit, in particular manual pressing unit, and a pressing unit of this type, it being the case that the pressing unit has a hydraulic pump, a moving part, a stationary part and a non-return valve, that, furthermore, the moving part is displaced into a pressing position by the build-up of a hydraulic pressure and the non-return valve moves automatically into an open position only in the presence of a predetermined hydraulic pressure corresponding to a pressing pressure, and that, furthermore, the moving part is configured for moving back automatically from the pressing position into an end position under the action of a restoring spring and the non-return valve is configured only to close once the moving part has reached the end position. In order to allow the moving part to be stopped optionally in position, the invention proposes, as far as the method is concerned, that the non-return valve is subjected to the action of a closure force, which is necessary for achieving the optional stopping in position of the moving part as the moving part moves back, when a pre-selected return position or a predetermined return position of the moving part is reached. It is advantageous here if it is possible to stop the return of the moving part before it reaches the end position by a triggering device, acting on the non-return valve. The open position of the non-return valve may also be arrested until a predetermined return position of the moving part has been reached.

19 Claims, 12 Drawing Sheets a
1
2
3
4
5
6
7

METHOD OF OPERATING A HYDRAULIC PRESSING UNIT, AND HYDRAULIC PRESSING UNIT

This application claims priority from German Application No. 20120204.2, filed on Dec. 13, 2001, and German Application No. 10206801.1, filed on Feb. 19, 2002.

The invention relates, in the first instance, to a method of operating a hydraulic pressing unit, in particular manual pressing unit, it being the case that the pressing unit has a hydraulic pump, a moving part, a stationary part and a non-return valve, that, furthermore, the moving part is displaced into a pressing position by the build-up of a hydraulic pressure and the non-return valve moves automatically into an open position only in the presence of a predetermined hydraulic pressure corresponding to a pressing pressure, and that, furthermore, the moving part is configured for moving back automatically from the pressing position into an end position under the action of a restoring spring and the non-return valve is configured only to close once the moving part has reached the end position.

As far as the prior art is concerned, you are referred to the applicant's WO 99/19947.

In the case of the known unit, such a method has already been realized to great advantage and has enjoyed widespread use. It is usually also the case that the configuration is advantageous and satisfactory. However, there are some cases in which it is desirable to stop the moving part early without the displacement of the moving part into the end position being obstructed in other cases. It is thus an object to provide a hydraulic manual pressing unit which allows the moving part to be stopped optionally in position.

For this purpose, the invention proposes that, before the end position of the moving part is reached, the non-return valve is subject to the action of a corresponding closure force.

This can take place optionally in any position of the moving part by means of acting directly on the non-return valve, if appropriate also by hand. For this purpose, it is advantageously possible to make use of the fact that the non-return valve has an actuating section extending outside the unit. In the simplest case, the user can subject said actuating section to the necessary force, for example, by hand. It is thus readily possible to interrupt the return in any position of the moving part. It is also easily possible for this means of action for the user to be shifted, if appropriate via lever transmission, into the region of the unit handle, for example to where, if appropriate via a further button, the triggering button of the unit is also disposed.

More specifically, it is also possible to provide that the non-return valve is arrested until a pre-selected or predetermined return position of the moving part has been reached. This makes it possible to provide the abovementioned closure force, for example, by means of a high-force restoring spring acting on the non-return valve. As the pressing pressure is reached, this high-force restoring spring is automatically moved into a prestressing position, by the hydraulic pressure also acting on the moving part, and immediately arrested there. The non-return valve is thus exposed to this force, in principle, during return of the moving part, but the arresting means absorbs this force until it is released by the user by actuation, or by the unit itself, when a predetermined return position of the moving part is reached. The action on the non-return valve takes place correspondingly by release of a previously stored closure force.

In one configuration of the known unit mentioned in the introduction, it is also possible for the non-return valve to be formed magnetically and for the abovementioned force to be produced by an electromagnet being switched on at a given point in time. It is then possible for the electromagnet either to pull the non-return valve into its closed position or, with equal poles located opposite one another, to push the non-return valve into its closed position. Furthermore, it is also possible to carry out electromechanical arresting. In this case an electrical actuating part, for example once again an electromagnet, pushes a mechanical arresting part into the displacement path of the non-return valve, the open position of the latter. In the same way, this locking can then be withdrawn again by electrical actuation.

The magnetic or electromagnetic action, however, clearly does not, or in any case does not necessarily, take place by the release of a previously stored closure force. Rather, it takes place by supplying power to a corresponding electromagnetic or electromechanical arrangement.

It is recommended to integrate the means for actuating the locking, or releasing the locking, of the non-return valve and/or the actuating means for producing the necessary closure force, irrespective of the position of the return part, in the actuating handle of the unit, said handle being present in any case. This is done straightforwardly for example, as has already been mentioned in principle, via a mechanical lever device which acts on the end of the non-return valve.

In a further-developed configuration, it may be provided that the actuating button for starting the electric motor, or the hydraulic pump connected thereto, is also provided, at the same time, with a button for acting on the locking part of the non-return valve.

In a further actual embodiment, it is possible for the triggering button to be suspended in a lever-like manner and to be provided with a locking pin which can be moved back counter to spring force and, for its part, engages beneath a locking part, adjustable counter to spring force and acting on the non-return valve, and can also run over the same again.

The invention proposes, as subject matter, a hydraulic pressing unit having a hydraulic piston running in a cylinder, it being possible for the hydraulic piston to be moved back counter to the force of a restoring spring.

In order to achieve the object of providing a more advantageous pressing unit, in particular manual pressing unit, the invention proposes that it is possible to stop the return of the hydraulic piston before it reaches the starting position by a triggering device, acting on the non-return valve.

In a first embodiment, this may be achieved in that the triggering device comprises a pulling or pushing part connected to the non-return valve. The pulling or pushing part passes through not just the valve cylinder but also a housing wall which also encloses the unit, usually outside the valve. It can be subjected, for example, to manual action. If, in the case of the configuration in accordance with WO 99/19947, the disclosure contents of this document are hereby included in full in the disclosure of the present application, also for the purpose of incorporating features of the related application in claims of the present application, the non-return valve is pulled or pushed into the closed position during the return of the moving part, the hydraulic volume is prevented from decreasing further. The moving part comes to a standstill. Upon renewed triggering actuation of the electrical motor, the moving part can then be moved, from the location at which it has been stopped, into the closed position again.

As far as a pulling part is concerned, it is possible, for example, for the tip of the closure valve to be formed as a rod passing through the housing, obviously with corresponding sealing. In the case of the known unit, an extension of the non-return valve which is oriented in the opening direction and passes through the housing wall is configured as the pulling part. Via a rocker part which is connected thereto, and ultimately only passes through the outer housing covering, it can be utilized for opening the non-return valve. This extension is then configured as a pushing part. It has a freely accessible end region on which it is possible to act in order to close the non-return valve.

In a further configuration, it may also be provided that an electromagnet acts on the non-return valve. In a fair number of embodiments, such a manual pressing unit is also operated by a storage battery, or else by direct connection to an electricity supply, for example in an assembly building. This may be used in order to provide an electromagnet associated with the non-return valve. Depending on the polarity in relation to the non-return valve, the electromagnet can either push or pull said valve into the closed position.

In a further configuration, it may be provided that the non-return valve is subjected to the action of a prestressing force which is sufficient for displacement into the closed position at any point in time at which the moving part is moving back. This may be important and advantageous in the first instance, irrespective of possible displacement into the closed position at any point in time of the return of the moving part, just from the point of view that the automatic return of the moving part depends as little as possible on the pressure which is produced by the compression spring acting on the non-return valve, this being so even in the case of the non-return valve being independent of the pressure produced by the restoring spring.

In respect of this aspect, the invention proposes, in the first instance, that the open position of the non-return valve is arrested until a predetermined return position of the moving part has been reached. According to the invention it is provided that the open position of the non-return valve is arrested mechanically, specifically until the moving part has been moved into its starting position or a desired return position of the moving part has been reached.

In one configuration, it may be provided that the non-return valve has a latching socket in which an arresting protrusion engages for the arresting operation. The latching socket is suitably provided to the rear of the active piston surface of the non-return valve.

The arresting protrusion which moves into the latching socket is suitably subjected to spring prestressing.

As far as the arresting protrusion is concerned, a separate disengaging part is provided and moves the arresting protrusion out of the latching socket, this in dependence on given mechanical conditions or pressure conditions, and as explained in more detail hereinbelow.

The disengaging part can interact with a ramp of the arresting protrusion. For this purpose, a conical surface or some other ramp-like surface is suitably formed on the arresting protrusion. The disengaging part has a surface which corresponds thereto. A sliding wedge action is produced as a result.

According to a first embodiment, the moving part can act mechanically on the disengaging part. The moving part is usually a piston of the pressing unit. The disengaging part projects, for mechanical activation, in the displacement direction of the piston, so that the piston or the moving part, as it is displaced, mechanically actuates the disengaging part in a certain section of the displacement path, preferably at the end of the displacement path.

According to a second embodiment, the disengaging part may be subjected to spring prestressing. The spring prestressing drives the disengaging part into the disengagement position. The spring prestressing is exceeded by the, hydraulic pressure which prevails during pressing and return of the moving part. It is only once the moving part is at a standstill that the hydraulic pressure drops to the extent where the disengaging part, as a result of the spring prestressing to which it is subjected, moves out of a movement path of the arresting protrusion, which then, because it itself is subjected to spring prestressing, moves out of the latching socket of the non-return valve and thus releases the latter for closure.

The disengaging part may also be used in order to make it possible for the arresting protrusion to be lifted out of the arresting position by manual actuation. For this purpose, in a simple version, the arresting protrusion is guided out of the housing at one end and, there, pulled out of the arresting position by hand, for example, counter to its prestressing force. The disengaging part is then the rearwardly projecting section of the arresting protrusion.

In this respect, however, it is also possible to provide a separate disengaging part which, at least over a certain movement region, interacts in a positively locking manner with the arresting protrusion and is, for example, in the form of a rocker. When the disengaging part is moved, the arresting protrusion is then inevitably also withdrawn from its arresting position. More specifically, it is also possible for the disengaging part, for this purpose, to be coupled to an actuating switch of the unit, for example to the triggering or starting switch of the unit, for example such that further actuating of the starting switch results in the arresting protrusion being withdrawn from the arresting position and thus in the moving part being stopped. Subsequent actuation of the starting switch then results, once again, in the electric motor starting up and the pump operating, so that a new pressing process begins.

The invention is explained further hereinbelow with reference to the attached drawing, although the latter only represents exemplary embodiments. In the drawing.

Figure 1:
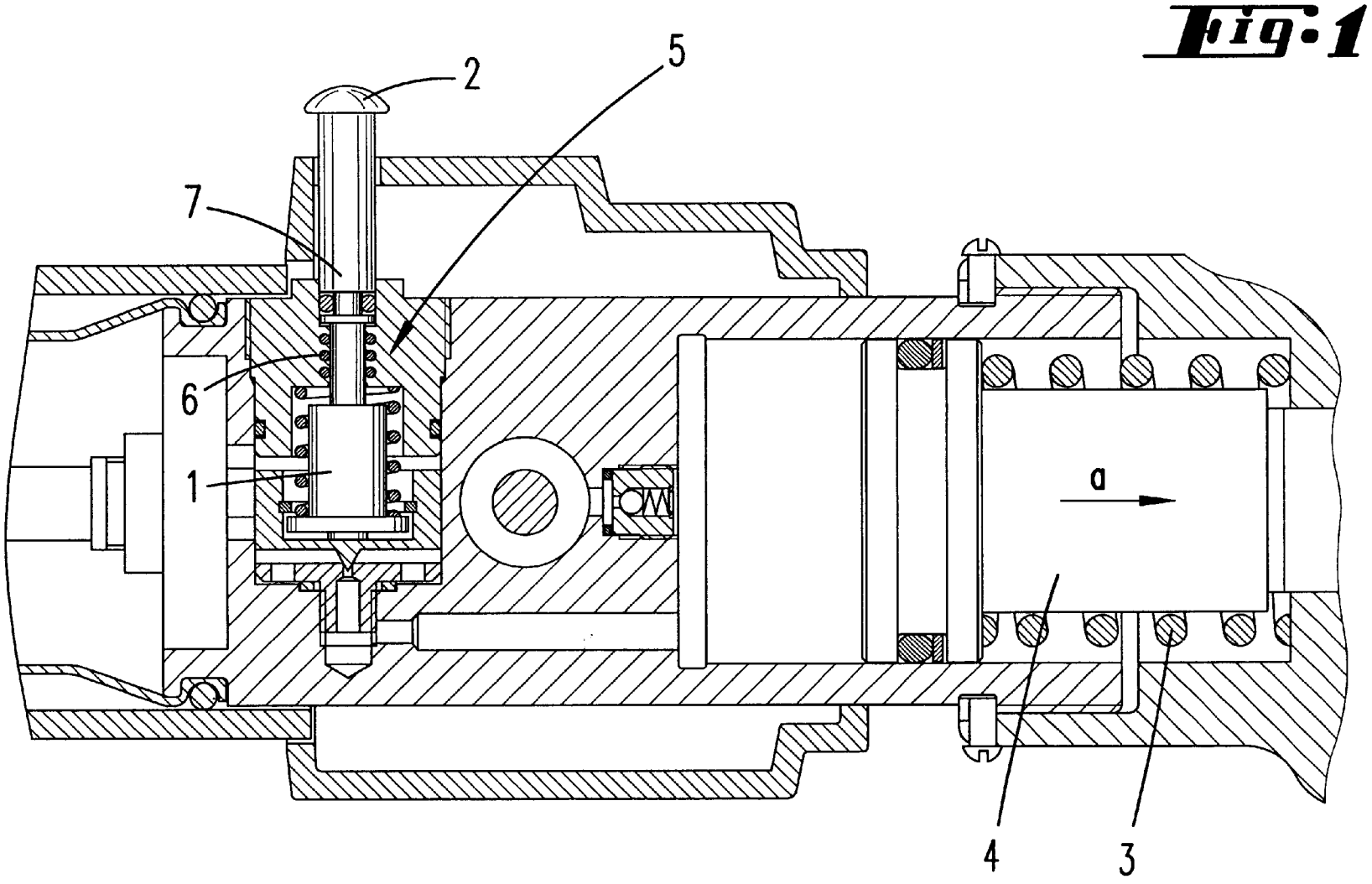
FIG. 1 shows a cross-sectional view of a hydraulic pressing unit with a device for optionally closing the non-return valve.

Illustrated and described, in the first instance in FIG. 1, is part of a hydraulic pressing unit as is illustrated, with the exception of the special features described here, in further detail, for example, in WO 99/19947. For an explanation of the design and the operation of the non-return valve and of the pressing unit in general, also for the rest of the exemplary embodiments described here, reference is thus also made in full to the abovementioned document, also for the purpose of incorporating features of this document in claims of the present application.

FIG. 1 incorporates two embodiments, which are also of separate importance.

It is important, in the first instance, that the non-return valve 1 has a pressing shoulder 2 projecting outward beyond the unit. This pressing shoulder can be used for optionally bringing the non-return valve 1 from its open position into its closed position in any position of the moving part 4, in this case a hydraulic piston, which is moved back by the spring 3. The moving part 4 or the hydraulic piston is then stopped at the location at which it is found at this point in time.

To supplement this, or as an alternative, it is possible to provide an electromagnet 5, which likewise acts on the non-return valve 1. The exemplary embodiment provides coil windings 6 which, when activated electrically, interact magnetically with an associated section, for example the section 7, of the non-return valve. This results in a pulling action, but a pushing action is just as possible. It is also possible for the through-passage section of the non-return valve to be used as an armature which is moved by the magnet.

The embodiment of FIGS. 2 to 6 also relates, in principle, to a hydraulic pressing unit as is known from the abovementioned WO 99/19947. In this case, however, the non-return valve 1 is permanently prestressed into the closed position, in the case of the exemplary embodiment by means of a compression spring 20, by such a force that, irrespective of the pressure exerted by the returning moving part 4, the non-return valve would move into the closed position at any time. It is prevented from doing this by an arresting protrusion 8 which, as is also explained more specifically hereinbelow with reference to the embodiments of FIGS. 9 to 12, moves into a corresponding cutout of the non-return valve.

It is important, then, that the arresting protrusion 8 is guided rearwardly out of the unit body 9 and forms an activating shoulder 10. A disengaging part 11 engages beneath the latter and, for its part, is fastened on the unit body 9 in a rocker-like manner about a point of rotation 12. At the same time, the disengaging part 11, or the mount 13 of the disengaging part 11, is rigidly connected to a triggering knob 14 of the unit. Upon actuation, the triggering knob 14 acts on an electric switch 15.

This is explained further in detail hereinbelow, with reference to FIGS. 3 to 6.

Figure 2:
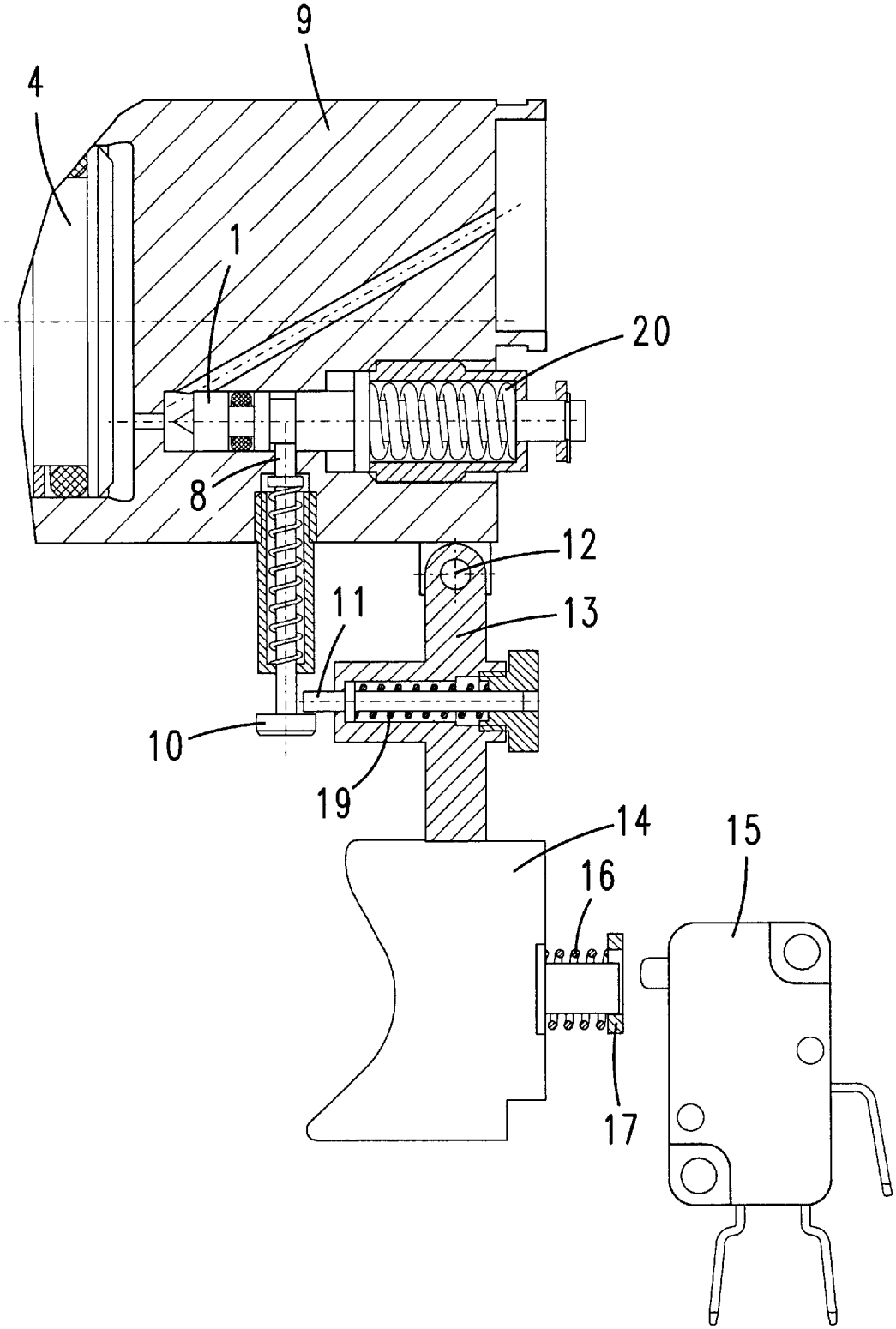
FIG. 2 shows a cross-sectional illustration, in detail form, of the pressing unit with button-actuated triggering for displacing the non-return valve into the closed position, in a first position.

FIG. 2 shows the state in which the electric motor is switched off. The hydraulic pressing unit is at rest. The non-return valve 1 is located in an open position and is arrested in this position by the arresting protrusion 8. The moving part 4 is located in a fully returned position.

Figure 3:
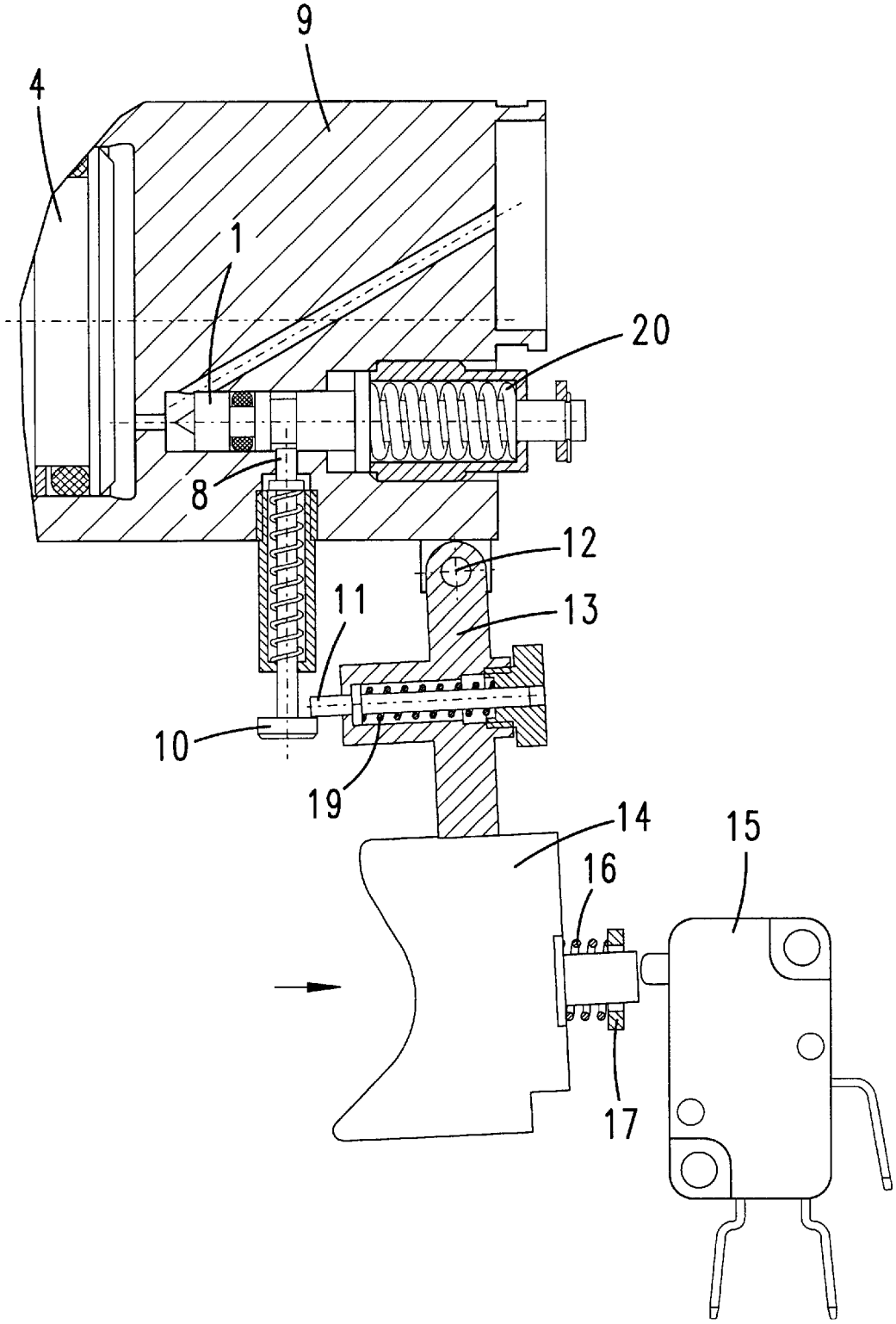
FIG. 3 shows the illustration according to FIG. 2 when the unit is started up.

FIG. 3 illustrates the state in which the user wishes to carry out a pressing operation. He/she begins to act on the triggering button 14. The latter has moved, counter to the action of the compression spring 16 which, at the other end, butts against a stationary housing part 17, in the direction of the electric switch 15. The disengaging protrusion 11 here moves along a circular path about the point of articulation 12. It has already withdrawn the arresting protrusion 8, in part, from its arresting position.

Figure 4:
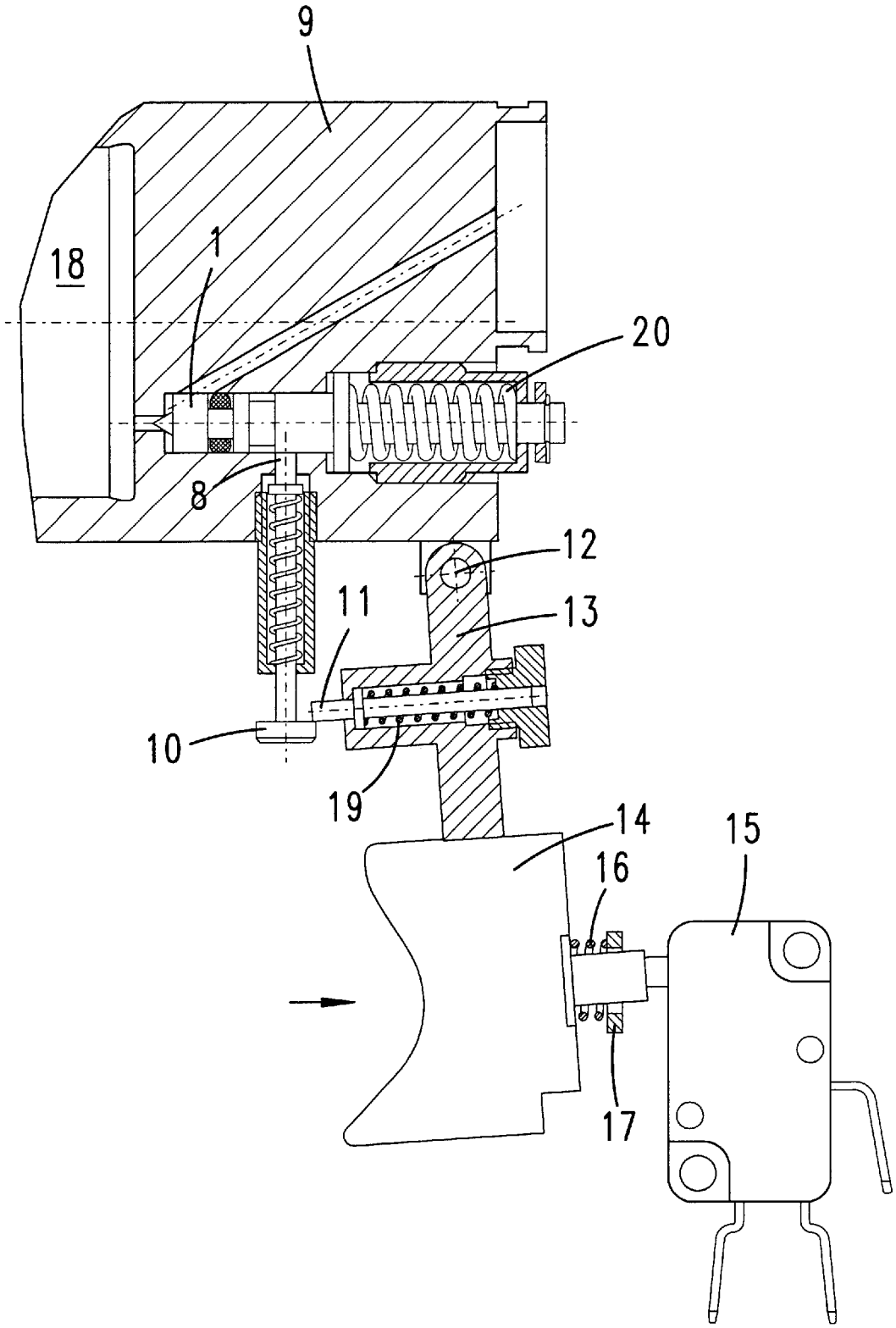
FIG. 4 shows an illustration following on from FIG. 3, the starting button having been pressed further and the pump started up.
Figure 5:
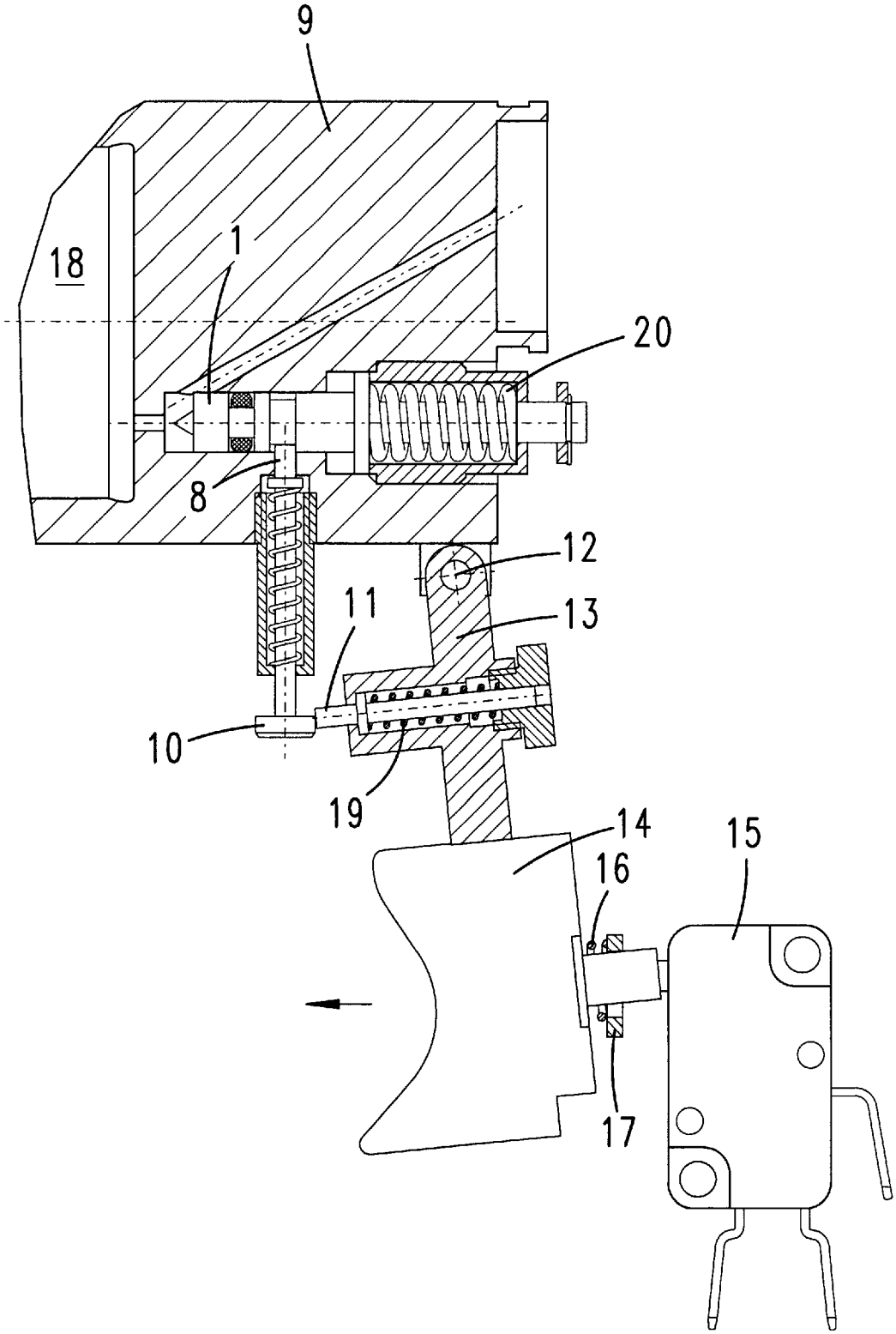
FIG. 5 shows an illustration following on from FIG. 4, once the triggering pressure of the non-return valve has been reached and the pump has been switched off; with release of the return movement of the starting button and locking of the non-return valve in the open position.

Thereafter, see FIG. 4, the user, by pressing the triggering button 14 further, has actuated the electric switch 15, so that the electric pump starts up and the hydraulic space 18 is filled with hydraulic fluid. At the same time, however, the disengaging protrusion 8 has been lifted out to the extent where the non-return valve 1 has been displaced into the closed position under the action of the compression spring 20. The hydraulic piston or the moving part 4 has already moved away from its end position; it is no longer visible in FIG. 4. Since, more specifically, the disengaging part 11 can also be moved back out of its foremost position, counter to the action of the compression spring 19, it is possible when the triggering button 14 is disengaged, as is illustrated in FIGS. 5 and 6, for the disengaging part 11 to snap back beneath the protrusion 10 without the arresting position of the arresting part 8 being adversely affected as a result.

Figure 6:
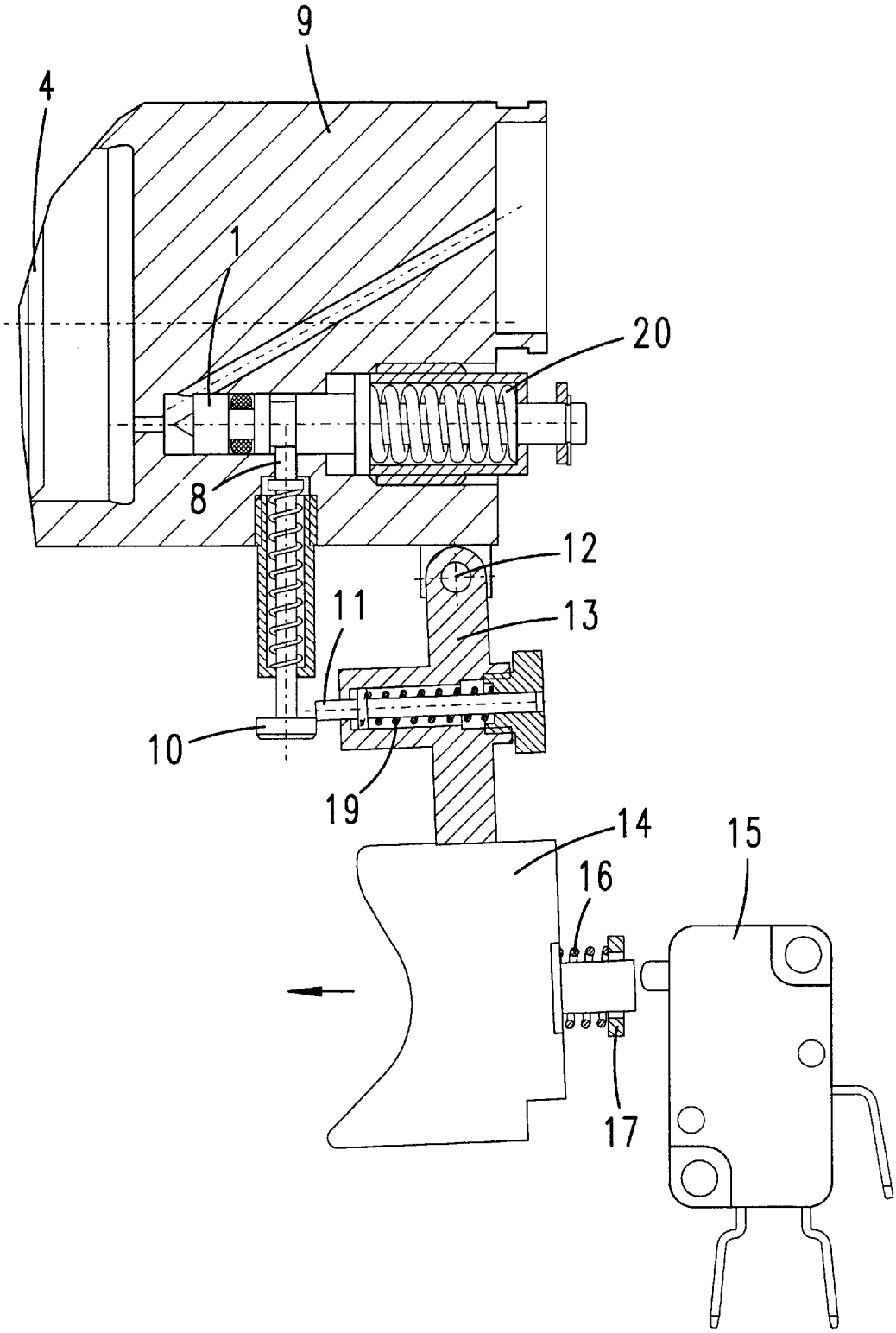
FIG. 6 shows an illustration following on from FIG. 5, with the disengaging part moving back beneath an activating shoulder, with the starting button released, and the non-return valve locked in the open position.

Following the position according to FIG. 6, the disengaging part then resumes the position of FIG. 2, although in this case the moving part is moved further in the direction of the pressing position by the pump, which continues to run. As soon as the pressing position has been reached, the pump switches off automatically, even when, as is usually the case, the triggering knob 14 is still pressed. At the same time, the non-return valve 1 automatically moves into its open position, counter to the action of the compression spring 20.

Figure 7:
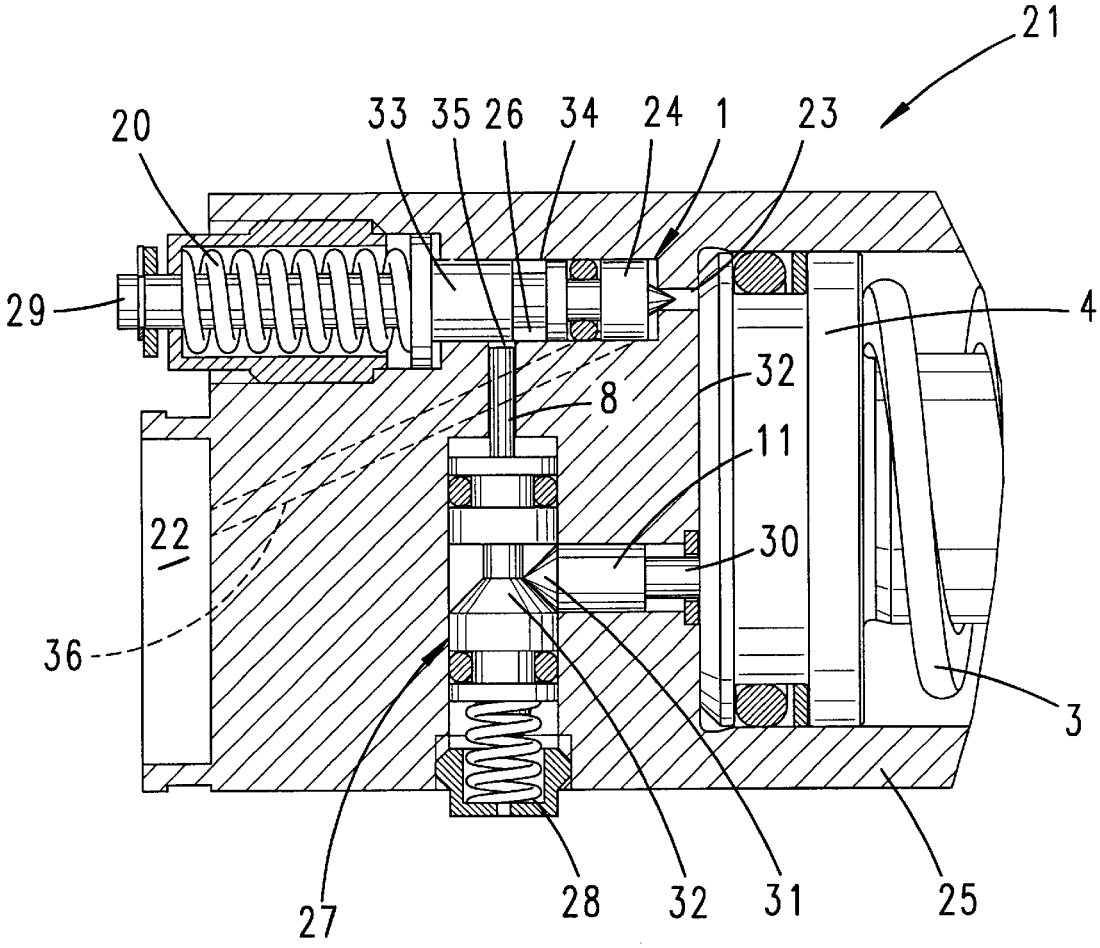
FIG. 7 shows a basic position of the second exemplary embodiment, in which the moving part is in its starting position and the non-return valve is closed.
Figure 8:
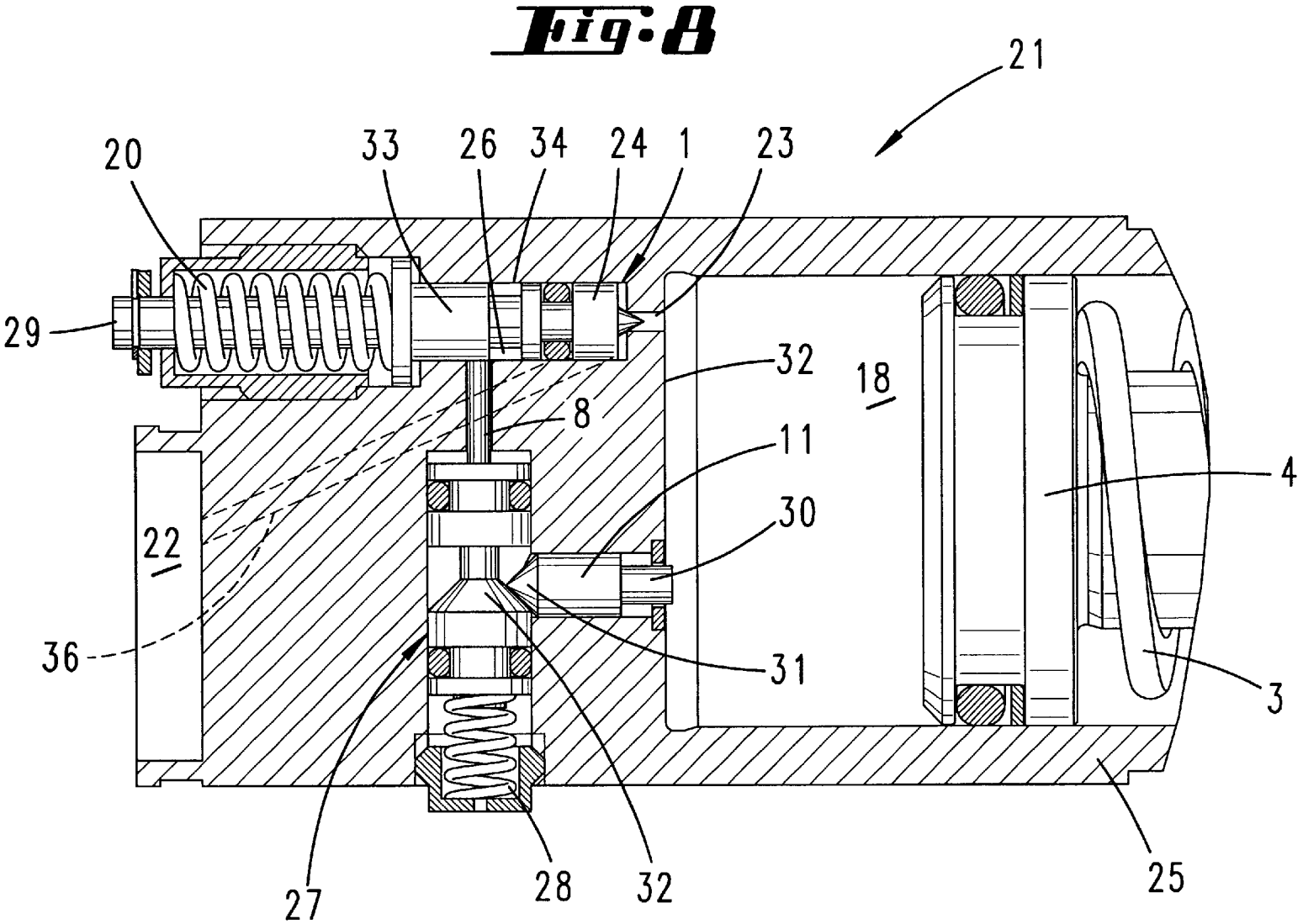
FIG. 8 shows the second exemplary embodiment once pressing pressure has been applied and the moving part moved into its pressing position; the non-return valve is closed.
Figure 9:
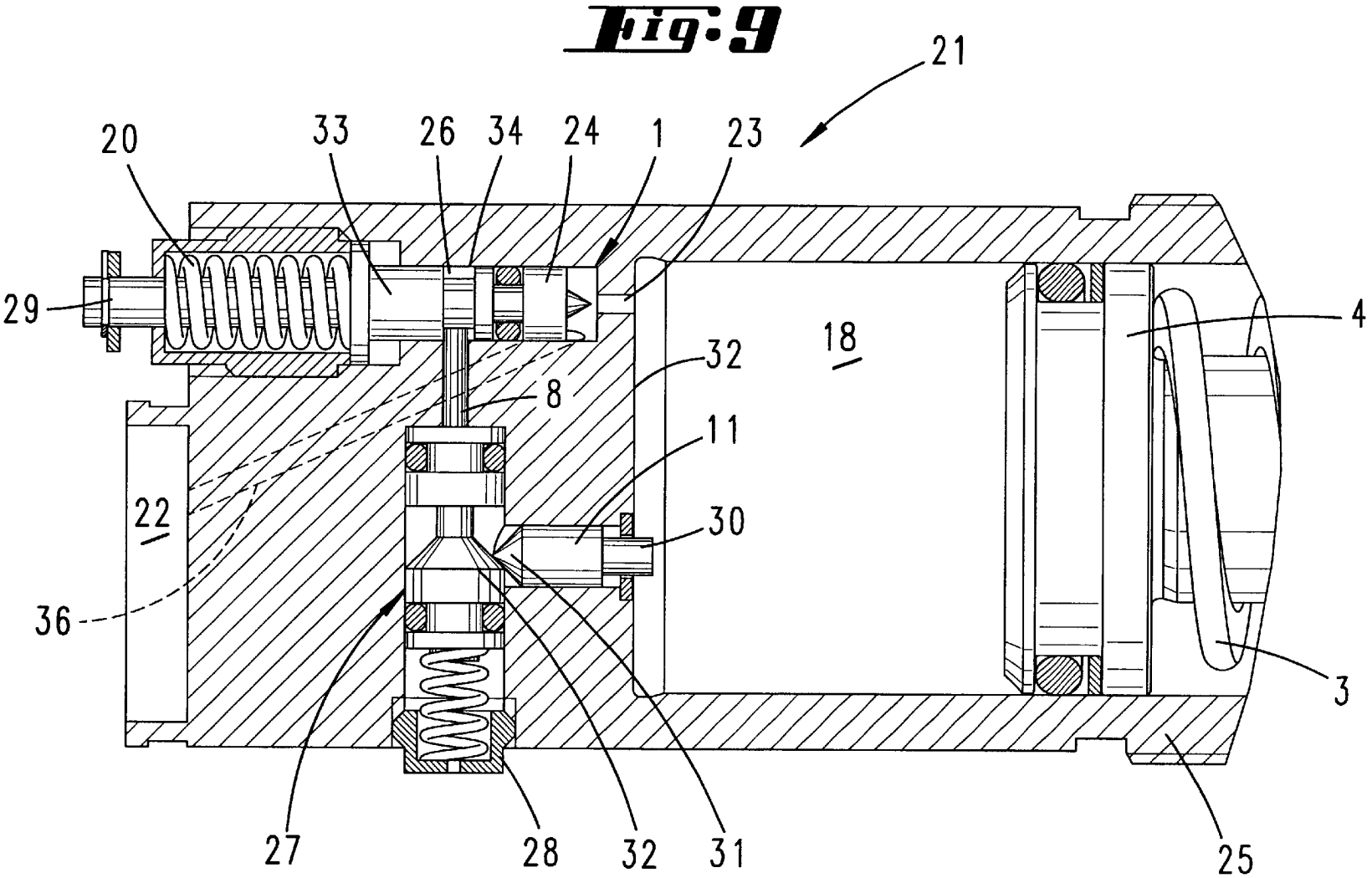
FIG. 9 shows a state of the second exemplary embodiment in which the non-return valve has opened and the moving part moves back.

FIGS. 7 to 9 deal with a second embodiment, which only relates to the operation of arresting the non-return valve forced into the open position by a positive pressure. Positive pressure here means that the pressure is higher than that required for closing the non-return valve for example only at the end of the return path of the moving part. Rather, the pressure is high enough for it to be suitable for closing the non-return valve in any position of the return of the moving part.

It is also the case here that the hydraulic pressing unit 21 has a hydraulic pump (not illustrated), by means of which hydraulic medium, usually oil, is pumped into the hydraulic space 18, see also FIG. 8, from a hydraulic supply space 22 (which is not illustrated any more specifically either). By means of the hydraulic pressure, a moving part 4, in this case a piston, can be displaced counter to the action of a restoring spring 3. The hydraulic pressure is built up until it has reached a predetermined pressing pressure at which the non-return valve 1, which acts as a pressure-release valve at the same time, opens.

For this purpose, the non-return valve 1 has an initially active, comparatively very small valve surface area which, in the case of the exemplary embodiment, corresponds to the cross-section provided by the bore 23.

For disengagement of the non-return valve 1, this cross-section requires as high a pressure as corresponds to the pressing pressure. Once the non-return valve 1 has been raised off, the larger surface area provided by the diameter of the piston section 24 takes effect. Once it has been triggered, the non-return valve 1 is thus—still—retained in the open position by a considerably lower pressure.

The moving part 4 is displaced relative to a stationary part 25. The terms moving part and stationary part may also be related to elements of the working region of the pressing unit which are not illustrated specifically. The moving part or the moving parts, for this purpose, are jaws which move together, or the moving part is a blade or a pressing mold which moves against a stop or a stationary countermold.

During the build-up of pressing pressure, this state being illustrated in FIG. 8, the hydraulic space 18 is subjected to ever-increasing pressing pressure, by the already mentioned pump (not illustrated), and the piston of the moving part 4 is subjected to increasing pressure until a pressing pressure has been reached.

The non-return valve 1 has a latching socket 26 which, in the case of the exemplary embodiment, is formed by an encircling groove in a piston section of the non-return valve 1. Also provided is an arresting part 27, which is prestressed in the direction of the non-return valve 1 under the action of a spring 28. The arresting part 27 has an arresting protrusion 8 which, when the non-return valve 1 is displaced into its open position, moves into the latching socket 26.

The non-return valve 1, for its part, is prestressed into its closed position by the action of the spring 20.

A handle 29, furthermore, is formed on the rear side of the non-return valve 1, in extension of a shank of the non-return valve 1, and makes it possible for the non-return valve to be displaced into its open position by hand. However, when the arresting protrusion 8 is in engagement, the valve cannot be closed by hand.

The arresting part 27, for its part, interacts with a disengaging part 11, which is formed as a valve piston. The disengaging part 11 has an activating protrusion 30 which projects into the displacement path of the moving part 4, in this case the piston.

The disengaging part 11 also has an actuating tip 31 which interacts with an actuating formation 32 on the arresting part 27. In the case of the exemplary embodiment, the actuating tip 31 and the actuating formation 32 are each formed conically.

If, beginning from the starting position in FIG. 7, oil is pumped into the hydraulic space 18 in order to move the moving part 4, the moving part 4 moves counter to the action of the spring 3, as is illustrated in FIG. 8. Along with release of the actuating protrusion 30, the arresting part 27 moves, by the action of the spring 28, until the arresting protrusion 8 strikes against the circumferential surface of the piston section 33, which is formed in front of the latching socket 26, as seen in the closing direction of the non-return valve 1. The piston section 33 corresponds, in terms of diameter to the free diameter of the cylinder 34 in which the non-return valve 1 moves.

In the starting position according to FIG. 7, the arresting protrusion 8, by the action of the spring 3, which forces the moving part 4 onto the activating protrusion 30 and thus displaces the disengaging part 11 back, has been moved back from the piston section 33 to form a clearance 35.

If, then, according to FIG. 8, the hydraulic pressure is built up to the pressing pressure, the arresting protrusion 8, with prestressing going beyond the same, as can be seen from FIG. 8, has been moved up onto the circumferential piston surface of the piston section 33. Taking into account the angle relationship between the disengaging part and the arresting part, this being provided by the conical surfaces 31 and 32, respectively, the arresting protrusion 8 is prestressed onto the piston section 33 to such an extent that the pressure in the cylinder space 18 up to the pressing pressure is exceeded by the action of the spring 28.

However, the latter is not absolutely necessary. It would also be possible for the action of the spring 28 to be substantially less. In this case, the arresting means would only move the arresting protrusion into the arresting recess 26 when the moving part 4 is being displaced back, under a substantially lower pressure in the cylinder space 18.

As soon as the pressing pressure has been reached and the non-return valve 1 has opened, this state being illustrated in FIG. 9, the latching socket 26 coincides with the arresting protrusion 8, so that the latter moves in by the action of the spring 28 (or, as has been indicated above, moves in at a later point in time when the pressure in the cylinder space 18 has dropped to the extent where the action of the spring 28 is sufficient but the moving part 4 has not yet been displaced back to the stop).

As a result, furthermore, the disengaging part 11, which, rather than being subjected to any spring prestressing, is only subjected to the action of the spring 28 and/or the oil pressure prevailing in the cylinder space 18, is displaced back further. It thus projects to an even greater extent into the movement path of the moving part 4.

The oil from the cylinder space 18 can flow out into the supply space 22 through the indicated line 36, which is released by the piston section 24 when the non-return valve is opened.

If, then, the moving part 4 strikes against the end surface of the activating protrusion 30 of the disengaging part 11, the latter is pushed in the direction of the arresting part 27 by the action of the spring 3 and thus, via the drive surfaces 31, 32, the arresting part 27 moves back counter to the action of the spring 28.

The non-return valve 1 can then be displaced into its closed position according to FIGS. 7 and 8 again by the action of the spring 20.

Figure 10:
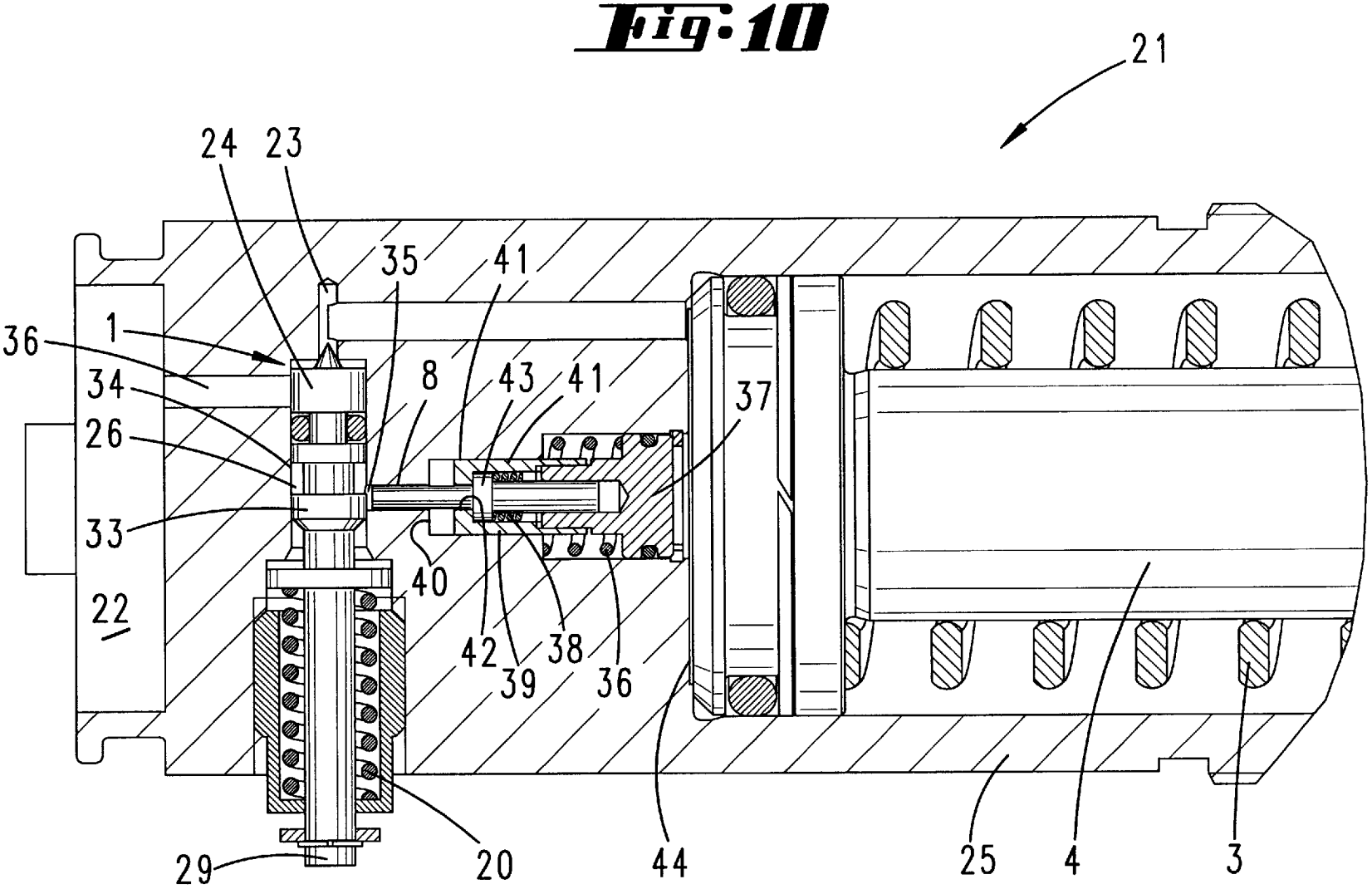
FIG. 10 shows the starting position for a third exemplary embodiment; the non-return valve is closed.
Figure 11:
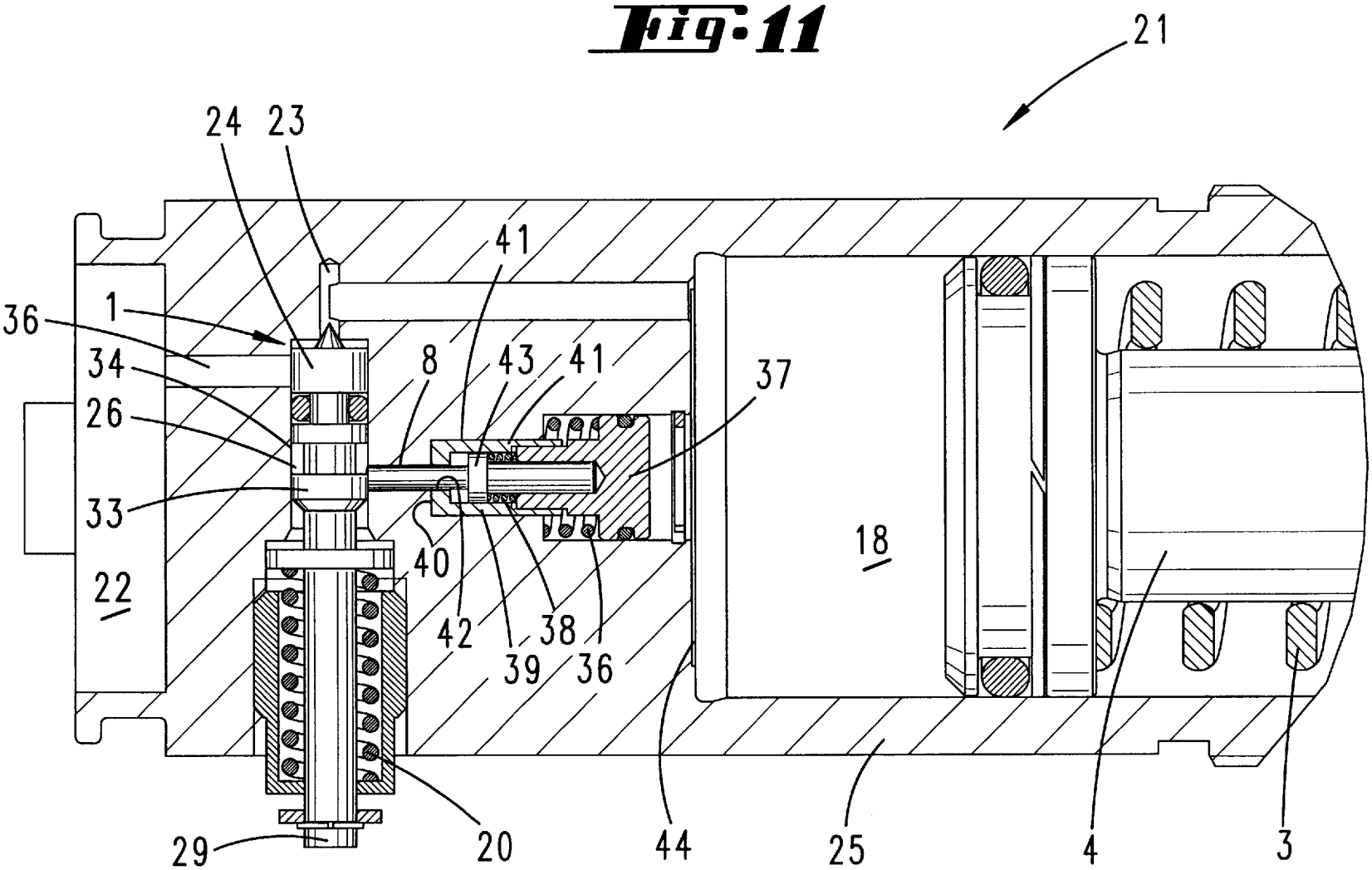
FIG. 11 shows a state of the third exemplary embodiment in which pressing pressure is built up and the non-return valve is closed.
Figure 12:
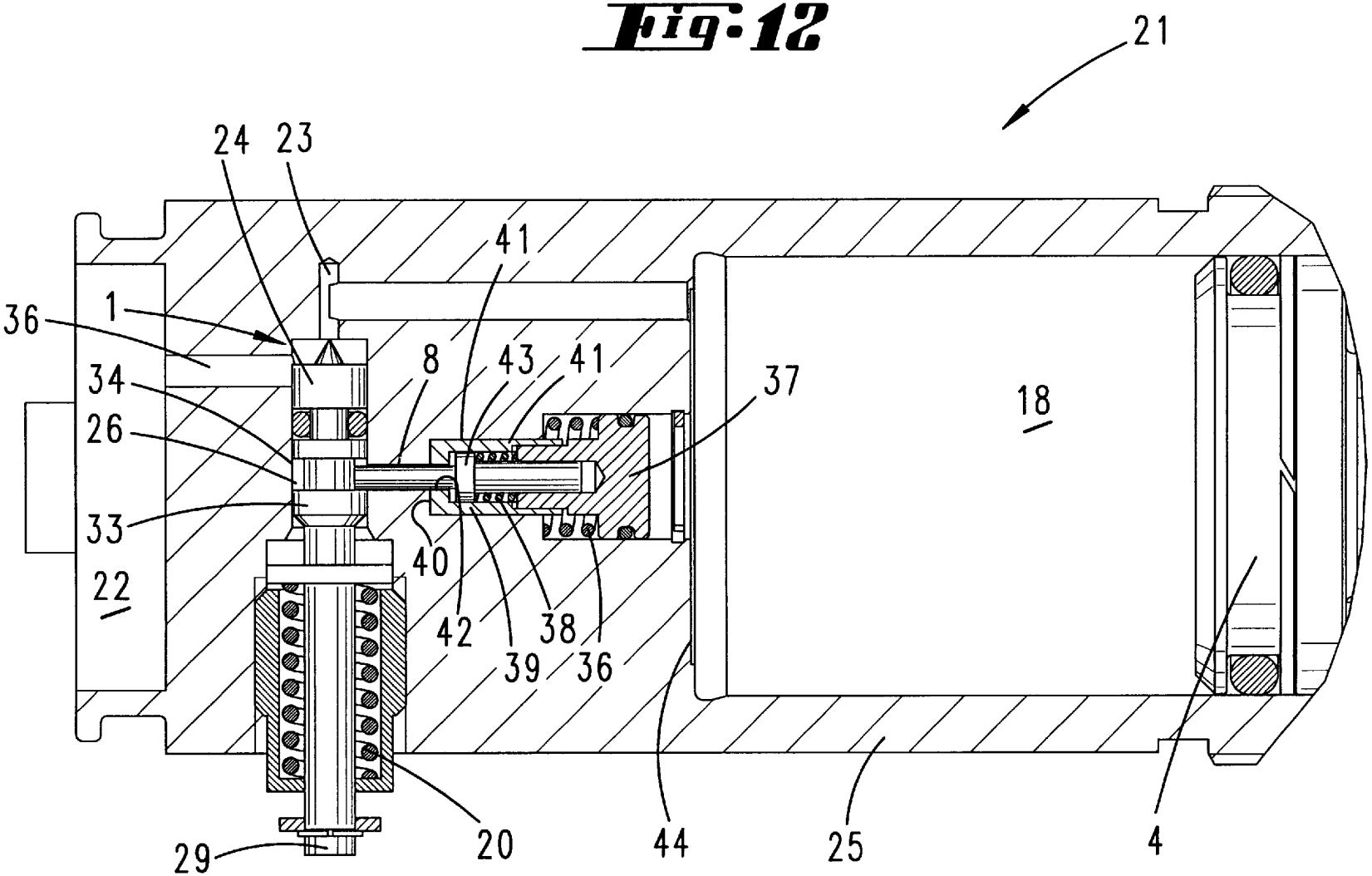
FIG. 12 shows a further state of the third exemplary embodiment; the non-return valve is open and the moving part moves back in the direction of its starting position.

The third exemplary embodiment is illustrated in FIGS. 10 to 12.

In this case, the previously described arresting part is combined in functional terms, in principle, with the disengaging part.

The non-return valve 1 corresponds to the non-return valve 1 described above and, in this respect, you are referred to the latter.

Also formed in the same way is the stationary part 25 with the moving part 4 and restoring spring 3 acting thereon.

The illustration of FIG. 10 shows the basic position, with the non-return valve 1 closed and with the arresting protrusion 8 spaced apart from the associated piston section 33 of the non-return valve 1.

In the case of the embodiment of FIGS. 10 to 12, the arresting protrusion 8, in the first instance, is subjected to prestressing by the spring 36. The arresting protrusion 8 is connected to a piston part 37 which is subjected directly to the hydraulic pressure acting in the cylinder space 18. In addition, however, the arresting protrusion can be displaced within the piston part 37. For this purpose, within the piston part 37, it is subjected to the action of the spring 38, by means of which the arresting protrusion 8, in dependence on a pressure acting on the piston part 37, is prestressed against the non-return valve 1.

If a pressing pressure is built up, see FIG. 11, in accordance with that state of the second exemplary embodiment which is described in relation to FIG. 8, the piston part 37 is subjected to this—increasing pressing—pressure. This pressing pressure overcomes the action of the spring 36, so that the piston part 37, together with its shank 39, is displaced in the direction of the non-return valve 1.

The piston part 37 may be displaced until the shank 39 strikes against the end 40 of the associated cylinder bore 41. In this state, that end surface of the arresting protrusion 8 which is assigned to the non-return valve 1 has already struck against the circumference of the piston section 33 of the non-return valve 1. As the piston part 37 is displaced to an increasing extent, the arresting protrusion 8 is displaced back, in which case the spring 38 takes effect.

The arresting protrusion 8, for this purpose, passes through a bore 42 in the piston section 39 of the piston part 37.

In the hollow piston section 39, the arresting protrusion 8 is guided in a moveable manner by means of a piston section 43, the spring 38 acting on that side of the latter which is directed away from the non-return valve 1.

As soon as the predetermined pressing pressure has been reached and the non-return valve 1 is displaced into its open position as a result, the arresting protrusion 8 enters into the latching recess 26, basically as has also already been described for the second exemplary embodiment. This state is illustrated in FIG. 12. The pressure still prevailing in the cylinder space 18, brought about by the spring 3, keeps the arresting protrusion 8 in the latching position according to FIG. 12. It is only when the moving part 4, say in this case the piston, comes into abutment against the end wall 44 of the cylinder space 18 that the pressure in the cylinder space 18 drops, so that the piston part 37 moves into the position according to FIG. 10 under the action of the spring 36. The arresting protrusion 8 is moved out as a result, so that, on account of the action of the spring 20, the non-return valve can be displaced back into its closed position according to FIG. 10.

All features disclosed are (in themselves) pertinent to the invention. The disclosure contents of the associated/attached priority documents (copy of the prior application) are hereby also included in full in the disclosure of the application, also for the purpose of incorporating features of these documents in claims of the present application.

What is claimed is:

1. A method of operating a hydraulic pressing unit, in particular a manual pressing unit, it being the case that the pressing unit has a hydraulic pump, a moving part, a stationary part and a non-return valve, that, furthermore, the moving part is displaced into a pressing position by the build-up of a hydraulic pressure and the non-return valve moves automatically into an open position only in the presence of a predetermined hydraulic pressure corresponding to a pressing pressure, and that, furthermore, the moving part is configured for moving back automatically from the pressing position into an end position under the action of a restoring spring and the non-return valve is configured only to close once the moving part has reached the end position, wherein the non-return valve is subjected to the action of a closure force, which is necessary for achieving the optional stopping in position of the moving part as the moving part moves back, when a pre-selected return position or a predetermined return position of the moving part is reached.

2. The method as claimed in claim 1, wherein the non-return valve is arrested mechanically in the open position.

3. The method as claimed in claims 1 or 2, wherein magnetic arresting is carried out.

4. The method as claimed in claim 1, wherein electromechanical arresting is carried out.

5. A hydraulic pressing unit, in particular a manual pressing unit, it being the case that the pressing unit has a hydraulic pump, a moving part, a stationary part and a non-return valve, that the moving part can be displaced into a pressing position by the build-up of a hydraulic pressure and the non-return valve moves automatically into its open position only in the presence of a predetermined hydraulic pressure corresponding to a pressing pressure, and that the moving part is configured for moving back automatically from the pressing position into an end position under the action of a restoring spring and the non-return valve is configured only to close once the moving part has reached the end position, wherein it is possible to stop the return of the moving part before it reaches the end position by a triggering device, acting on the non-return valve.

6. The pressing unit as claimed in claim 5, wherein the triggering device comprises a pulling or pushing part connected to the non-return valve.

7. The pressing unit as claimed in claim 5 or 6, wherein an electromagnet acts on the non-return valve.

8. The pressing unit as claimed in claim 5, wherein the non-return valve is subjected to the action of a prestressing force which is sufficient for displacement into the closed position at any point in time at which the moving part is moving back.

9. The pressing unit as claimed in claim 5, wherein the open position of the non-return valve is arrested until a predetermined return position of the moving part has been reached.

10. The pressing unit as claimed in claim 9, wherein the open position of the non-return valve is arrested mechanically.

11. The pressing unit as claimed in claim 9, wherein the non-return valve is arrested by an arresting protrusion and wherein provided for the purpose of disengaging the arresting protrusion is a separate disengaging part, which moves the arresting protrusion out of a latching socket.

12. A hydraulic pressing unit having a hydraulic pump, a moving part and a stationary part and a non-return valve, it being the case that the moving part moves from a starting position into a pressing position, the non-return valve moves automatically into an open position in dependence on a hydraulic pressure corresponding to the pressing pressure, and the moving part moves back under the action of a restoring spring, wherein the open position of the non-return valve is arrested until a predetermined return position of the moving part has been reached.

13. The pressing unit as claimed in claim 12, wherein the non-return valve has a latching socket in which an arresting protrusion engages for the arresting operation.

14. The pressing unit as claimed in claim 13, wherein the arresting protrusion is forced into an arresting position under spring prestressing.

15. The pressing unit as claimed in claim 13, wherein a separate disengaging part is provided and moves the arresting protrusion out of the latching socket.

16. The pressing unit as claimed in claim 15, wherein the disengaging part interacts with a ramp of the arresting protrusion.

17. The pressing unit as claimed in claim 15, wherein the moving part can act on the disengaging part.

18. The pressing unit as claimed in claim 15, wherein the moving part is a piston, and wherein the disengaging part projects into the displacement path of the piston.

19. The pressing unit as claimed in claim 15, wherein the disengaging part is forced into its disengagement position under spring prestressing, and wherein the spring prestressing is exceeded by the hydraulic pressure which prevails during pressing and return of the moving part.

* * * * *